United States Patent [19]

Sneed

[11] 4,128,393

[45] Dec. 5, 1978

[54] FLAME SHIELDING DEVICE

[75] Inventor: Jackson B. Sneed, Hixson, Tenn.

[73] Assignee: Humphreys, Hutcheson & Moseley, Chattanooga, Tenn.

[21] Appl. No.: 766,191

[22] Filed: Feb. 7, 1977

[51] Int. Cl.[2] ..... F23D 15/00

[52] U.S. Cl. ..... 431/351; 431/151

[58] Field of Search ..... 431/151, 350, 347, 263, 431/351

[56] References Cited

U.S. PATENT DOCUMENTS

| | | | |
|---|---|---|---|
| 1,998,339 | 4/1935 | Stansbury | 431/350 X |
| 2,647,383 | 8/1953 | Florman | 431/151 |
| 3,122,195 | 2/1964 | Kimmel et al. | 431/350 X |
| 3,353,376 | 11/1967 | Tackett | 431/151 X |

FOREIGN PATENT DOCUMENTS

| | | | |
|---|---|---|---|
| 456889 | 11/1936 | United Kingdom | 431/151 |

*Primary Examiner*—Edward G. Favors

*Attorney, Agent, or Firm*—Merriam, Marshall & Bicknell

[57] ABSTRACT

A gas flame shield having a concave, spoon or shell-like shape and mounted to partially enclose the space surrounding the flame. Apertures are provided in the shield to prevent pressure reduction in the enclosed space and to provide an inlet for controlled entry of air to the flame.

2 Claims, 4 Drawing Figures

FLAME SHIELDING DEVICE

BACKGROUND

Gas burning appliances and other gas burning devices generally depend on a continuously burning pilot flame for igniting the main flame and for maintaining proper operation. If the pilot flame is extinguished, ignition will not take place and the appliance ceases to perform its function. Such accidental extinguishing or flame-out of the pilot flame is most often caused by wind gusts or drafts entering the pilot compartment and blowing out the pilot flame. This problem exists with a wide variety of appliances which employ gas-fired heat, including household appliances and devices as well as mobile equipment used for recreational purposes and outdoor gas burning devices. Flame-out of the pilot flame thus results in numerous service calls and other expenses and inconveniences and has been a persistent problem with gas burning devices. Small, solid wall flame shields have been used with commercial pilot assemblies, but generally have not eliminated the problem.

SUMMARY OF THE INVENTION

The present invention provides an improved flame shield adapted to be attached to standard pilot assemblies by conventional means. The shield is a spoon-or shell-shaped wall structure placed between the flame and the source of wind gusts or drafts. The shield has adequate concavity to partly enclose the space surrounding the pilot flame to deflect the gusts or drafts from the flame area, and contains a plurality of apertures located so as to permit entry of air to the flame area for proper combustion and to avoid pressure reduction in the shield cavity. The apertures may be placed with their longitudinal axes in various orientations with respect to one another so as to selectively distribute air flowing through the shield while substantially avoiding direct impingement upon the flame.

The shield closely surrounds the burner nozzle and then extends outwardly away from and over the nozzle in a spoon-or shell-shaped configuration. This configuration results in a concave protected space for the pilot flame, with the shield enclosing the flame completely in the direction of the expected wind gusts or drafts (the "back") and at least partially enclosing the flame above and at the sides, leaving the flame open at the front.

The apertures in the shield are preferably located in the area of the shield to the rear of and somewhat above the burner nozzle. Their size and number are sufficient to: (1) permit a flow of air through the shield into the flame area for proper combustion; (2) to avoid pressure reduction within the partially enclosed flame area; and (3) to prevent air burble around the shield and into the flame area.

The apertures in the shield serve to control and limit the amount of air entering the flame area and preferably serve to direct the air flow so that it is diffused as it enters the protected flame area and does not impinge directly onto the flame. The apertures thus permit entry of sufficient air to sustain proper combustion and to provide sufficient pressure within the shield cavity to prevent gust air from burble around the edges of the shield, while the shield protects the flame from flame-out due to wind gusts or drafts by deflecting the main body of the moving air from the flame area.

While the shield of this invention is specifically described in connection with a pilot flame, it may also be used for other flame shielding purposes such as for candles, alcohol lamps, camping equipment and similar fuel burning instruments.

DESCRIPTION OF THE DRAWINGS

The invention will be better understood from the following detailed description thereof, taken in conjunction with the accompanying drawings, in which.

DETAILED DESCRIPTION OF THE INVENTION

Figure 2:
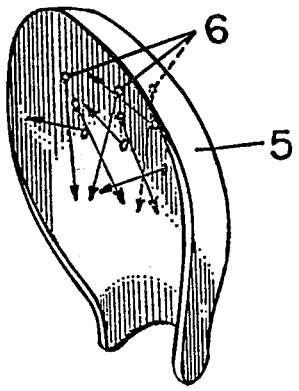
FIG. 2 is a perspective view of a shield of the invention showing its spoon-or shell-shaped configuration and indicating by arrows the orientation of air flow through various apertures in the shield.

As shown in FIG. 2, the shield 5 of this invention consists of a concave, spoon-or shell-shaped wall structure, preferably made of ceramic or other suitable flame resistant material. In its lower portion, shield 5 is shaped to fit closely around the burner nozzle 3, as shown more clearly in FIG. 3. Shield 5 then extends outwardly to form a concave wall preferably of such dimension as to partially enclose the space about flame 7 (shown e.g., in FIG. 3) above and on three sides of the flame.

The size and shape of shield 5 will vary, depending on the size of the pilot assembly with which it is designed to be used. In the embodiment shown and described herein, shield 5 is approximately 2.5 inches high, 1.5 inches wide at the widest portion, and 0.5 inches deep at the deepest portion.

Figure 1:
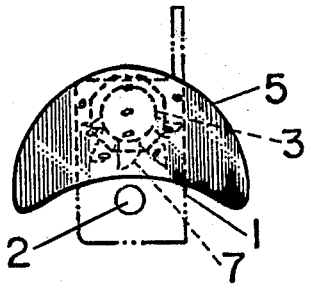
FIG. 1 is a top plan view of the shield of the invention in place over a conventional pilot flame assembly (shown partially in phantom lines)

A plurality of apertures 6 extend through the upper-rear portion of shield 5. Apertures 6 may be in sufficient number and suitably spaced and located to permit entry of enough air for proper combustion, to avoid reduced pressure within the cavity of shield 5, and to prevent air burble around the edges of shield 5 during wind gusts or drafts. In the particular embodiment shown and described herein, ten apertures the diameter of 16-gauge wire located to the "back" of shield 5 and above nozzle 3 have been found to be effective for the practice of the invention with a shield of the dimensions specified above. Depending on the particular size of and application for shield 5, apertures 6 may be made to vary in size, location, and number. As shown in FIG. 1, apertures 6 may also be formed through the material of shield 5 with their longitudinal axes in various orientations with respect to one another so as to diffuse the flow of air away from direct impingement on flame 7 (shown in FIG. 3). The flow of air and orientation of apertures 6 are shown by the arrows in FIG. 2. It will be apparent, however, that the particular orientation of any one aperture is not critical, nor is it essential that the apertures 6 be in varying orientation, nor that the concave wall have such thickness as will provide for such varying orientation.

Figure 3:
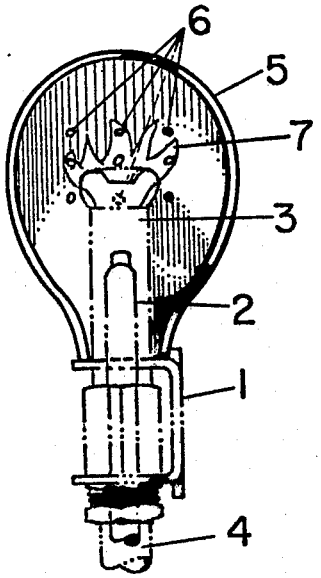
FIG. 3 is a front elevational view of a shield of the invention in place over a conventional pilot flame assembly.
Figure 4:
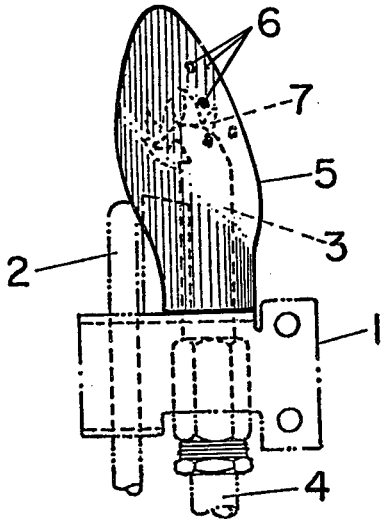
FIG. 4 is a side elevational view of a shield of the invention in place over a conventional pilot flame assembly.

As illustrated in FIG. 4, shield 5 is adapted to be mounted in a conventional manner, such as by glue or fasteners, to a conventional pilot assembly. The pilot assembly illustrated consists of a mounting bracket 1, a thermocouple 2, and a burner nozzle 3 into which gas is introduced through a gas line 4. As shown in FIGS. 1, 3, and 4, shield 5 is adapted to enclose the space about flame 7 at the "back" (i.e., the side of nozzle 3 facing the source of wind gusts or drafts), to the sides, and above the flame in a canopy fashion, thus providing a protected area within the concavity of shield 5 in which flame 7 may burn. The preferred location of apertures 6 is best shown in FIG. 3. In the particular conventional pilot assembly shown, e.g., in FIG. 3, the upper portion of nozzle 3 is extended and shaped to form a solid flame-shaping wall. It is not essential that such a wall be present for successful operation of the shield of this invention.

In operation, shield 5, containing apertures 6 serves to effectively shield flame 7 against flame-out from all but the most extreme wind gust situations.

The foregoing detailed description has been given for clearness of understanding only, and no unnecessary limitations should be understood therefrom, as suitable modifications thereto for particular assemblies and uses within the scope of the invention will be obvious to those skilled in the art.

What is claimed is:

1. A device adapted to be attached to a fuel burning instrument for shielding the flame generated by said instrument from air gusts, said device comprising:

shielding means mountable on said instrument for shielding said flame from air gusts and including means forming a concave wall adapted to enclose the space surrounding said flame at the back, to the sides, and above the flame; and means associated with said shielding means for permitting controlled passage of air there through comprising a plurality of apertures in said shielding means the longitudinal axes of which are in various orientations with respect to one another, whereby the flow of air through said shielding means is diffused to substantially avoid direct impingement of air upon said flame.

2. The device of claim 1 in which said shielding means is shell-shaped and is of ceramic material.

* * * * *